US008950640B2

(12) United States Patent
Iannello et al.

(10) Patent No.: US 8,950,640 B2
(45) Date of Patent: Feb. 10, 2015

(54) TORSO TO WAIST LOAD TRANSFER APPARATUS

(75) Inventors: Christopher A J Iannello, Rolling Meadows, IL (US); Martin J. Nilsen, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/237,714

(22) PCT Filed: Aug. 3, 2012

(86) PCT No.: PCT/US2012/049431

§ 371 (c)(1), (2), (4) Date: Feb. 7, 2014

(87) PCT Pub. No.: WO2013/022726

PCT Pub. Date: Feb. 14, 2013

(65) Prior Publication Data

US 2014/0183233 A1 Jul. 3, 2014

Related U.S. Application Data

(60) Provisional application No. 61/521,032, filed on Aug. 8, 2011.

(51) Int. Cl.
*A45F 5/00* (2006.01)
*A41D 13/00* (2006.01)
(Continued)

(52) U.S. Cl.
CPC ..... *A45F 5/00* (2013.01); *A41D 13/0007* (2013.01); *A45F 3/14* (2013.01); *A41D 2400/48* (2013.01); *A45F 5/02* (2013.01); *A45F 2003/001* (2013.01); *A45F 2003/144* (2013.01)
USPC ..... 224/272; 224/637; 224/660; 224/576

(58) Field of Classification Search
CPC ..... A45F 3/14; A45F 3/08; A45F 3/06; A45F 2003/003; A45F 2003/144; F41H 1/02
USPC ..... 224/272, 628, 630, 634, 637–641, 660, 224/663, 665, 671, 672, 675, 576
See application file for complete search history.

(56) References Cited

U.S. PATENT DOCUMENTS 4,318,502 A * 3/1982 Lowe et al. ..... 224/153
5,464,137 A * 11/1995 Shirdavani ..... 224/265
(Continued)

FOREIGN PATENT DOCUMENTS

WO 2011002784 A1 1/2011

OTHER PUBLICATIONS

ISR and WO for PCT/US2012/049431 mailed Nov. 7, 2012.

*Primary Examiner* — Brian D Nash
*Assistant Examiner* — Corey Skurdal

(57) ABSTRACT

An adjustable load transfer apparatus adapted to transfer a portion of a load between a torso-covering garment and a belt at the user's waist. The apparatus includes a post adapted for insertion into the interior passageway of a female body. The insertable post includes cutouts disposed in spaced-apart, stacked relation along a lateral edge. The thickness dimension of the insertable post is such that the insertable post can pass beneath a locking tooth in the female body when the locking tooth is in a raised position. The cutouts are sized and positioned to receive the locking tooth when the locking tooth is lowered. The apparatus is adapted to releasably engage webbing loops disposed at the surface of the torso-covering garment and/or the belt structure.

20 Claims, 7 Drawing Sheets

(51) Int. Cl.

| | |
|---|---|
| ***A45F 3/14*** | (2006.01) |
| *A45F 5/02* | (2006.01) |
| *A45F 3/00* | (2006.01) |

(56) References Cited

U.S. PATENT DOCUMENTS

| | | | | | |
|---|---|---|---|---|---|
| 5,829,652 | A * | 11/1998 | Denzer et al. | 224/270 |
| 5,984,157 | A * | 11/1999 | Swetish | 224/631 |
| 7,591,401 | B2 * | 9/2009 | Sandler | 224/201 |
| 7,865,975 | B2 | 1/2011 | Davies et al. | |
| 8,166,694 | B2 * | 5/2012 | Swan | 42/90 |
| 8,297,562 | B1 * | 10/2012 | Yeates et al. | 248/118.3 |
| D709,797 | S * | 7/2014 | Iannello et al. | D11/218 |
| 2008/0010730 | A1 | 1/2008 | Twito et al. | |
| 2010/0294820 | A1 | 11/2010 | Neibarger | |
| 2012/0175390 | A1 * | 7/2012 | Rogers et al. | 224/182 |
| 2012/0192335 | A1 | 8/2012 | Crye | |
| 2014/0325803 | A1 * | 11/2014 | Iannello et al. | 24/460 |

* cited by examiner

TORSO TO WAIST LOAD TRANSFER APPARATUS

CROSS-REFERENCE TO RELATED APPLICATION

This application is a U.S. National Phase of International Application Number PCT/US2012/049431 filed Aug. 3, 2012 and claims the benefit of, and priority from, U.S. Provisional Application 61/521,032 filed Aug. 8, 2011. The contents of such Provisional Application are hereby incorporated by reference in their entirety as if fully set forth herein.

TECHNICAL FIELD

The present disclosure relates generally to load dispersal systems, and more particularly, to an apparatus for shifting weight from a vest or other torso-covering garment to a belt structure supported at the waist. Such transfer shifts a portion of a load being carried by a wearer from the shoulders to the waist. Dispersing the load reduces fatigue during prolonged use. A multiplicity of such load dispersal devices may be used to enhance the load dispersal benefit if desired.

BACKGROUND

In many environments, relatively heavy vests or other torso-covering garments may be used. By way of example only, and not limitation, such garments may be used by outdoors enthusiasts, law enforcement officers or military personnel. The mass of such garments may be increased by the insertion of protective plate structures, by filling pockets, and/or by the attachment of external pouches, ammunition, survival equipment and the like to surface webbing structures which are present on many such garments. By way of example only, external equipment may be attached to surface webbing forming part of a so called "MOLLE" system as will be well known to those of skill in the art. As the mass of the vest or other torso-covering garment is increased, an increased load is placed on the wearer's shoulders. This concentration of load may lead to fatigue during prolonged use or during periods of substantial exertion.

In light of the above, it would be desirable to provide a system to reduce the load concentration at a wearer's shoulders so that the load may be distributed to other muscle groups. By spreading the load to different muscle groups, fatigue may be reduced.

SUMMARY OF THE INVENTION

In one exemplary construction, the present disclosure provides advantages and alternatives over the prior art by providing a two piece assembly adapted to transfer a portion of a load between a torso-covering garment and a belt structure at the user's waist. Such transfer acts to distribute the load between the user's shoulders to the user's hips and legs. The load is thereby distributed more evenly among muscle groups and fatigue may be reduced over periods of prolonged use.

In accordance with one exemplary aspect, the present disclosure provides a load transfer apparatus adapted to transfer at least a portion of a load from a torso-covering garment to a belt structure supported at a user's waist so as to reduce stress on the user's upper body. The load transfer apparatus includes a female body with an open ended interior passageway defining a travel path across the female body. The female body includes a deformable upper wall segment of flexible, resilient character bordering the interior passageway with a locking tooth projecting away from the upper wall into the interior passageway. A liftable outwardly projecting tab is operatively connected to the deformable upper wall segment such that upon lifting up on the tab, the deformable upper wall segment flexes upwardly and the locking tooth is elevated from an unbiased first position to a raised second position. Upon release of the tab, the deformable upper wall segment rebounds to its initial condition and the locking tooth returns to the unbiased first position. The female body is adapted to releasably engage webbing loops disposed at the surface of the torso-covering garment and/or the belt structure. The load transfer apparatus further includes an insertable post adapted for insertion into the interior passageway. The insertable post includes a plurality of cutouts disposed in spaced-apart, stacked relation along at least one lateral edge. The thickness dimension of the insertable post is such that the insertable post can pass beneath the locking tooth when the locking tooth is in the raised second position. The cutouts are sized and positioned to receive the locking tooth when the insertable post is in inserted relation within the interior passageway and the locking tooth is lowered to the unbiased first position. The insertable post may be adapted to releasably engage webbing loops disposed at the surface of the torso-covering garment and/or the belt structure.

Other exemplary features and advantages of the disclosure will become apparent to those of skill in the art upon review of the following detailed description, claims and drawings.

Figure 1:
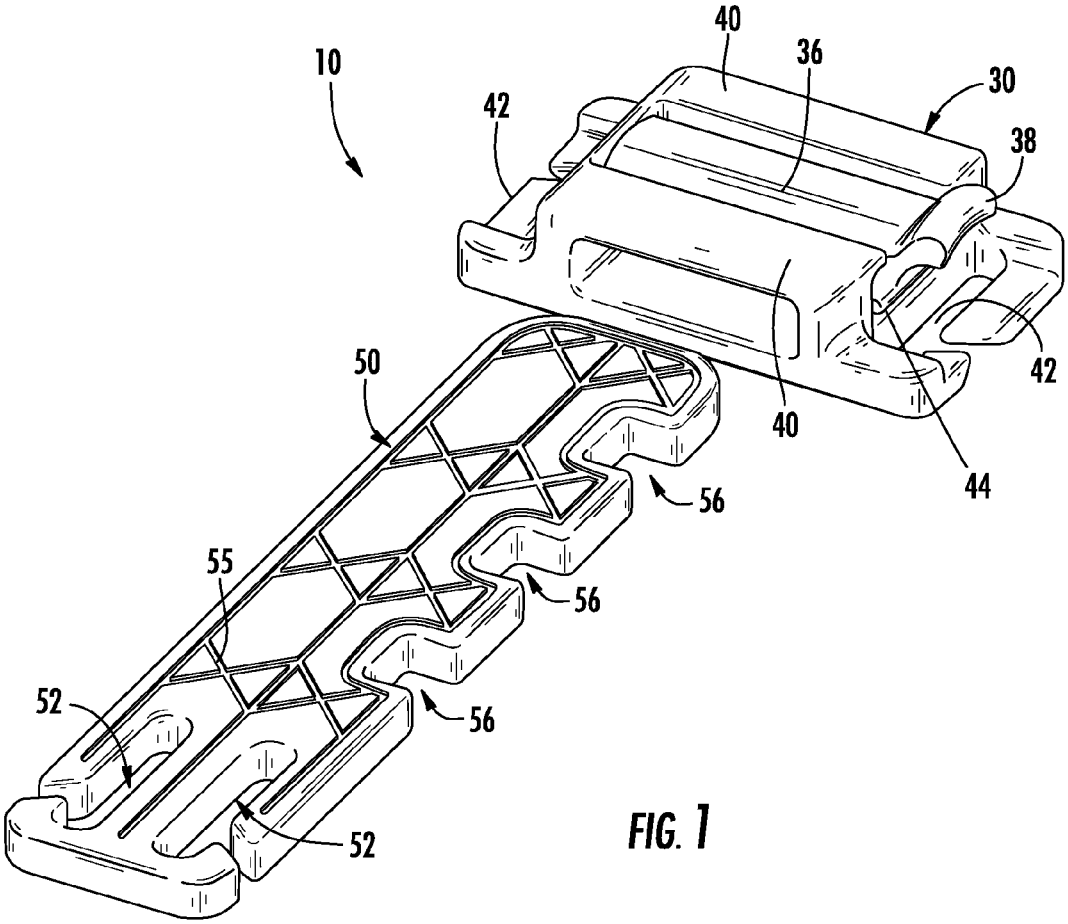
FIG. 1 is a schematic perspective view illustrating the components of a first exemplary embodiment of a load transfer assembly according to the present disclosure in separated relation.

Before exemplary embodiments are explained in detail, it is to be understood that the disclosure is in no way limited in its application or construction to the details and the arrangements of the components set forth in the following description or illustrated in the drawings. Rather, a load transfer apparatus in accordance with the present disclosure is capable of other embodiments and of being practiced or carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Reference will now be made to the drawings, wherein to the extent possible, like elements are designated by like reference numerals throughout the various views. As best seen through joint reference to FIGS. 1 and 2, an exemplary load transfer apparatus designated generally as 10 in accordance with the present disclosure is shown. As illustrated in FIG. 2, according to one exemplary practice the load transfer apparatus 10 is adapted to extend between a vest 12 or other torso-covering garment such as a jacket or the like and a belt 14. In this regard, the term "belt" is to be understood to include any structure worn generally at a user's waist such that its mass is supported by the user's hips and legs The torso-covering garment and the belt may be either separate or connected to one another. As will be described more fully hereinafter, the load transfer apparatus 10 acts to transfer a portion of the weight of the vest 12 to the belt 14 thereby allowing the vest load to be distributed between the user's shoulders and hips, rather than being carried entirely by the upper body. Such load distribution is believed to facilitate a more even distribution of weight among muscle groups thereby reducing the potential for fatigue.

In the illustrated, exemplary arrangement, the vest 12 includes one or more vest webbings 16 disposed at the surface of the vest 12. As shown, the vest webbings 16 may include connection elements 18 in the form of connective stitching, mechanical attachments, adhesives or the like attaching the vest webbings 16 to the surface of the vest 12. The connection elements 18 may be disposed periodically along the length of the vest webbings to form series of vest loops 20 between the connection elements 18 such that the loops 20 are adapted to matedly receive male elements in pass-through relation. By way of example only and not limitation, the vest webbings 16 may be formed from segments of elastomeric or inelastic fabric, although other materials as may be desired may likewise be used. If desired, the vest webbings 16 may be in the form of a so called "MOLLE" surface attachment system adapted for attachment of equipment as will be well known to those of skill in the art. However, other arrangements may likewise be used.

In the exemplary arrangement, the belt 14 includes one or more belt webbings 22. As shown, the belt webbings 22 may include connection elements 24 in the form of connective stitching, mechanical attachments, adhesives or the like attaching the belt webbings 22 to the surface of the belt 14. The connection elements 24 may be disposed periodically in spaced relation along the length of the belt webbings 22 to form series of loops 26 between the connection elements 24 such that the loops 26 are adapted to matedly receive male elements in pass-through relation. By way of example only and not limitation, the belt webbings 22 may be formed from segments of elastomeric or inelastic fabric, although other materials as may be desired may likewise be used.

Figure 2:
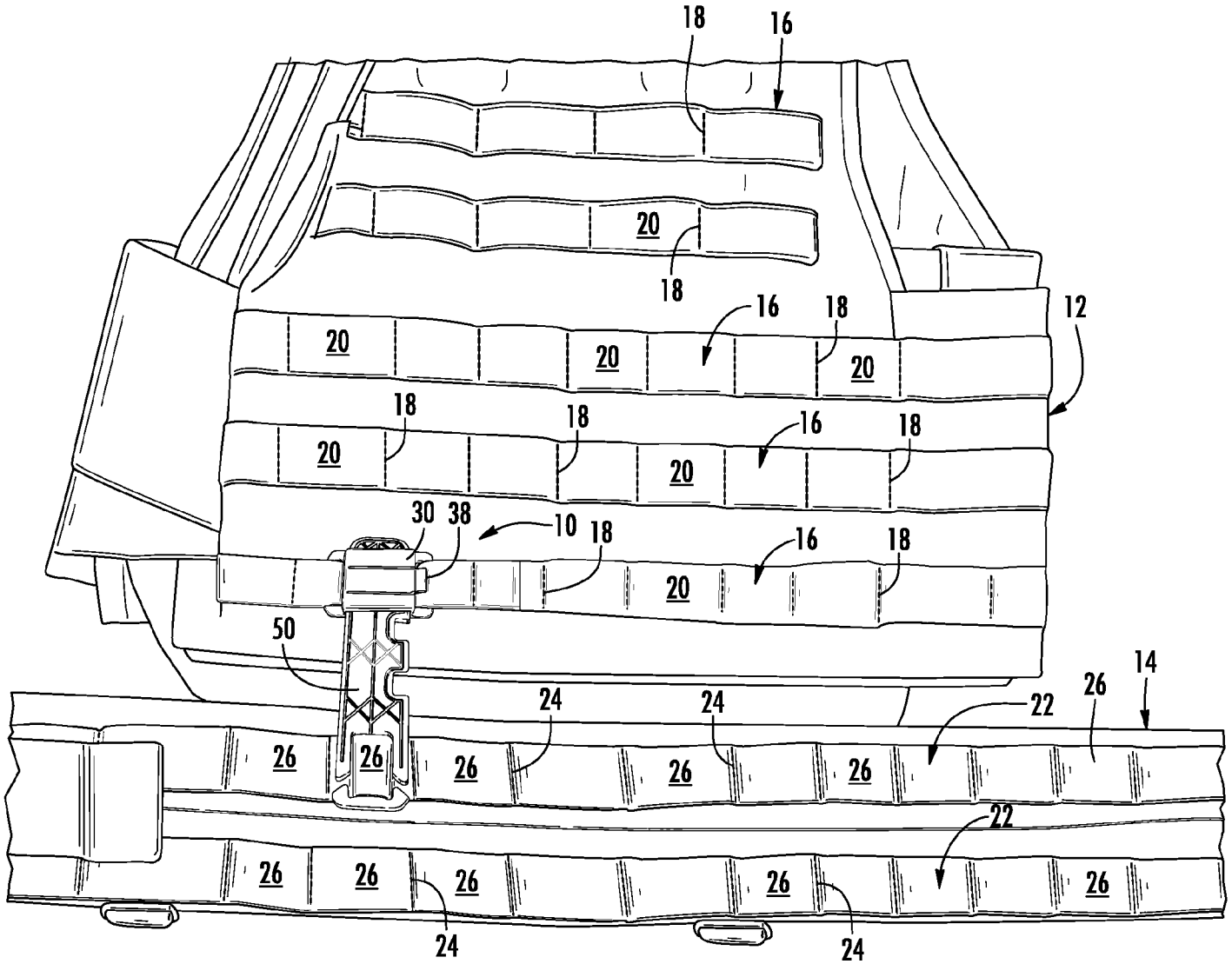
FIG. 2 is a schematic view illustrating the exemplary load transfer assembly of FIG. 1 disposed in operative condition between the surface webbing on a vest and the surface webbing on a belt.
Figure 3:
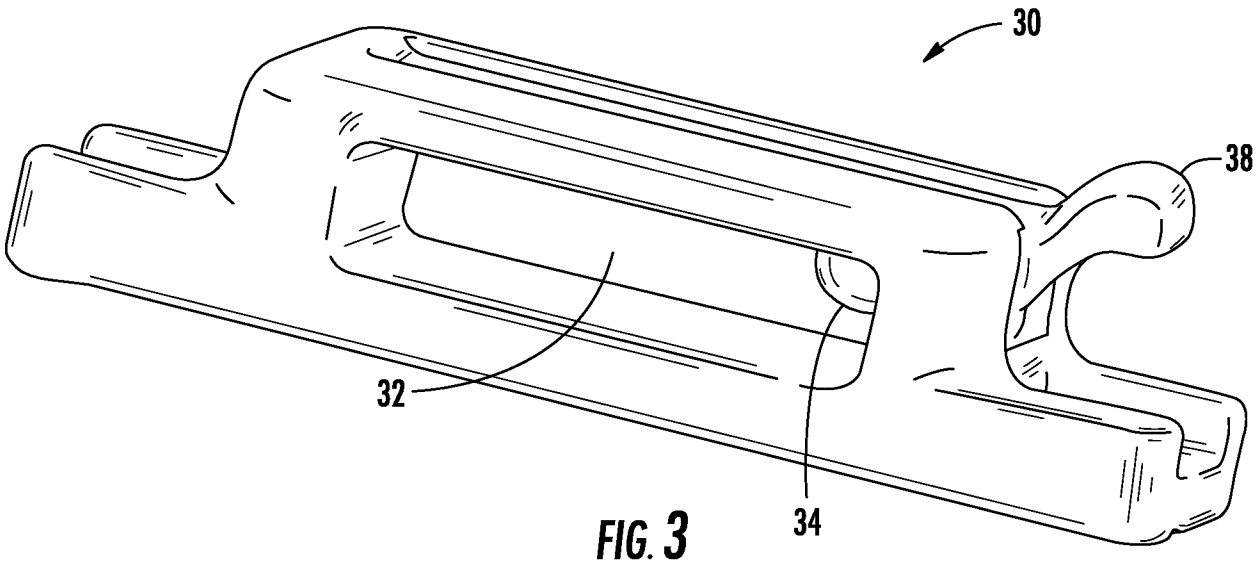
FIG. 3 is a schematic perspective view illustrating the locking female body of the exemplary load transfer assembly of FIG. 1.
Figure 4:
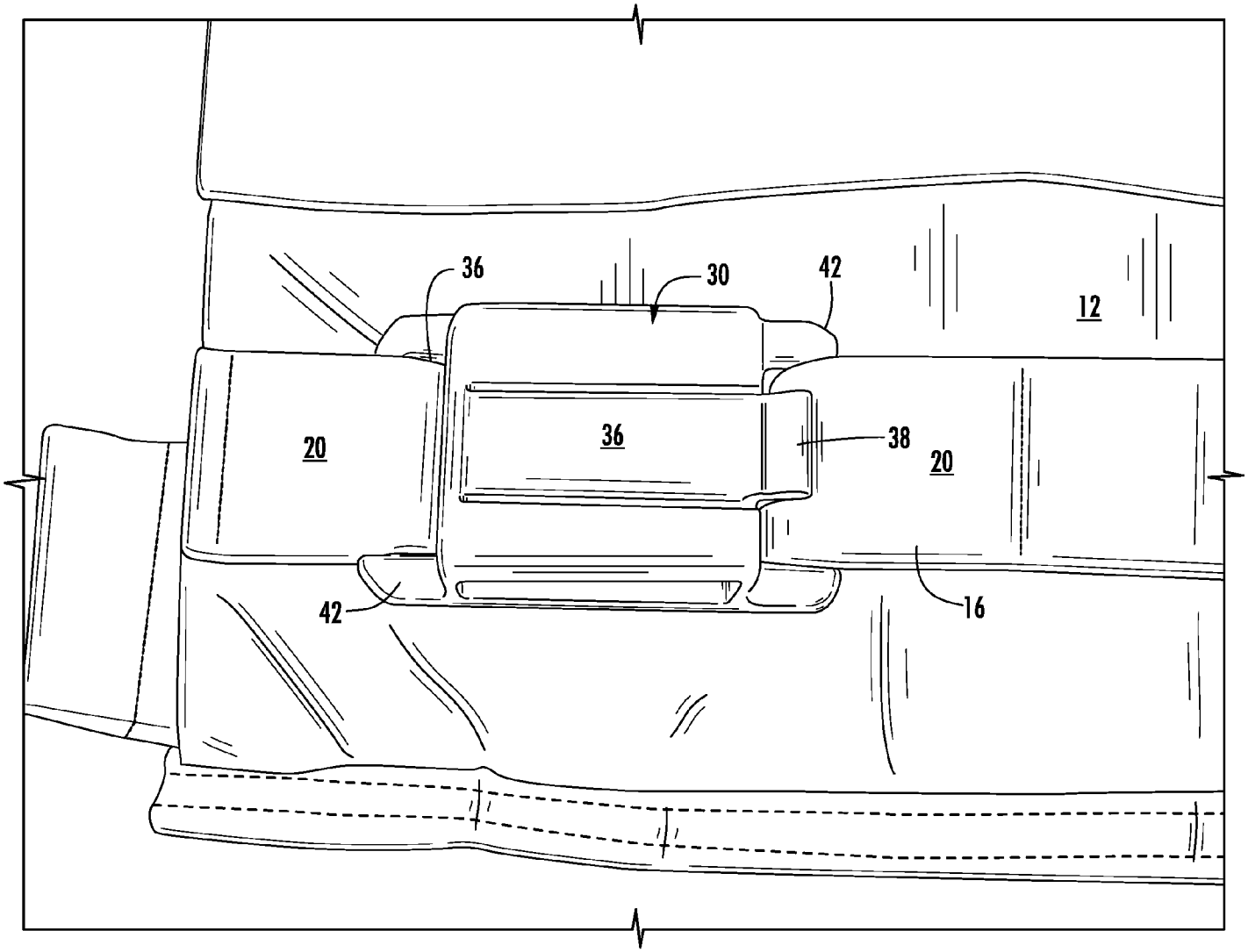
FIG. 4 is a schematic perspective view illustrating the locking female body of FIG. 3 held within webbing at the surface of a vest.

As best illustrated through joint reference to FIGS. 1-4, in the exemplary construction the load transfer apparatus 10 may have a two-part construction including a locking female body 30 adapted to be secured to a portion of the vest webbing 16 (FIG. 4). By way of example only, and not limitation, such a female body 30 may be formed as a unitary structure from a rigid high impact plastic or other suitable material using techniques such as injection molding or the like as will be well known to those of skill in the art. Of course, other constructions and materials also may be used.

As best seen in FIG. 3, the female body 30 has a generally open end box construction which is hollow at the interior to define an interior passageway 32 extending through the female body 30. In this regard, the interior passageway 32 may be substantially surrounded by walls formed by the female body 30 so as to be enclosed on four sides. In the illustrated exemplary embodiment, the interior passageway 32 has a substantially rectangular cross-section, although other geometries may likewise be used. As will be described more fully hereinafter, the interior passageway is configured to provide a travel path for axial acceptance of an insertable post 50 (FIG. 1).

In the illustrated exemplary embodiment, a locking tooth 34 is disposed at the interior of the interior passageway 32. The locking tooth 34 may be molded integrally with the upper wall 36 of the female body 30 overlying the interior passageway 32 so as to project downwardly from a lateral edge of the upper wall into the interior passageway 32. A thumb tab 38 may project upwardly and away from the lateral edge of the upper wall 36 in adjacent relation to the locking tooth 34. According to one exemplary practice, the thumb tab 38 may be integrally molded with the upper wall 36 during formation of the female body. However, the thumb tab 38 also may be may be attached separately if desired.

In operation, the thumb tab acts on the upper wall 36 as a lever such that raising the thumb tab 38 causes the upper wall 36 to flex in a resilient manner and resulting in the locking tooth 34 being raised from its normal unbiased position within the interior passageway 32. Thereafter, upon release of the thumb tab 38, the upper wall rebounds to its original position and the locking tooth 34 is lowered back to its normal unbiased position within the interior passageway 32.

As best seen in FIG. 1, according to one exemplary practice, the locking tooth 34 and the thumb tab 38 may be connected adjacent to a free edge of a resilient reduced thickness portion of the upper wall 36 defining a flexible span disposed in connected relation between a pair thicker strengthening ribs 40. The reduced thickness portion of the upper wall 36 may be useful in increasing local flexibility while maintaining resiliency so as to aid in raising and lowering the locking tooth 34 in response to lifting the thumb tab 38. However, a uniform thickness upper wall of adequate resilient character may be used if desired. As shown, the thumb tab 38 may be relatively large and project a significant distance away from the upper wall 36 to an elevation slightly above the upper wall 36. Such an oversized thumb tab may be useful in providing a mechanical advantage while also accommodating gloved hand operation. As shown, the base of the liftable thumb tab 38 may include a pair of opposing ears 44 (only one shown) projecting outwardly away from both sides of the base of the thumb tab at a position below the upper wall 36. In the event of extreme lifting of the thumb tab 38, the opposing ears 44 will be raised into contact with the underside of the strengthening ribs 40 as the reduced thickness portion of the upper wall deforms. In this contacting condition, further lifting of the thumb tab 38 is blocked. The opposing ears 44 thus act as a stop to prevent over lifting, and to thereby avoid undesired permanent deformation of the upper wall 36.

As best seen through joint reference to FIGS. 1 and 4, the female body 30 may include a pair of opposing split eyelets 42 adapted to receive a portion of the vest webbing 16 in threaded relation as shown in FIG. 4. That is, each of the split eyelets 42 may engage a vest loop 20 such that the female body 30 may be held in position relative to the vest webbing 16 when not in use. In this regard, the split eyelets 42 each may engage portions of the same vest loop 20 or each may engage different vest loops depending on the distance covered by the vest loops 20. Accordingly, the female body 30 may be connected to the vest webbing without regard to the size of the vest loops 20.

Figure 5:
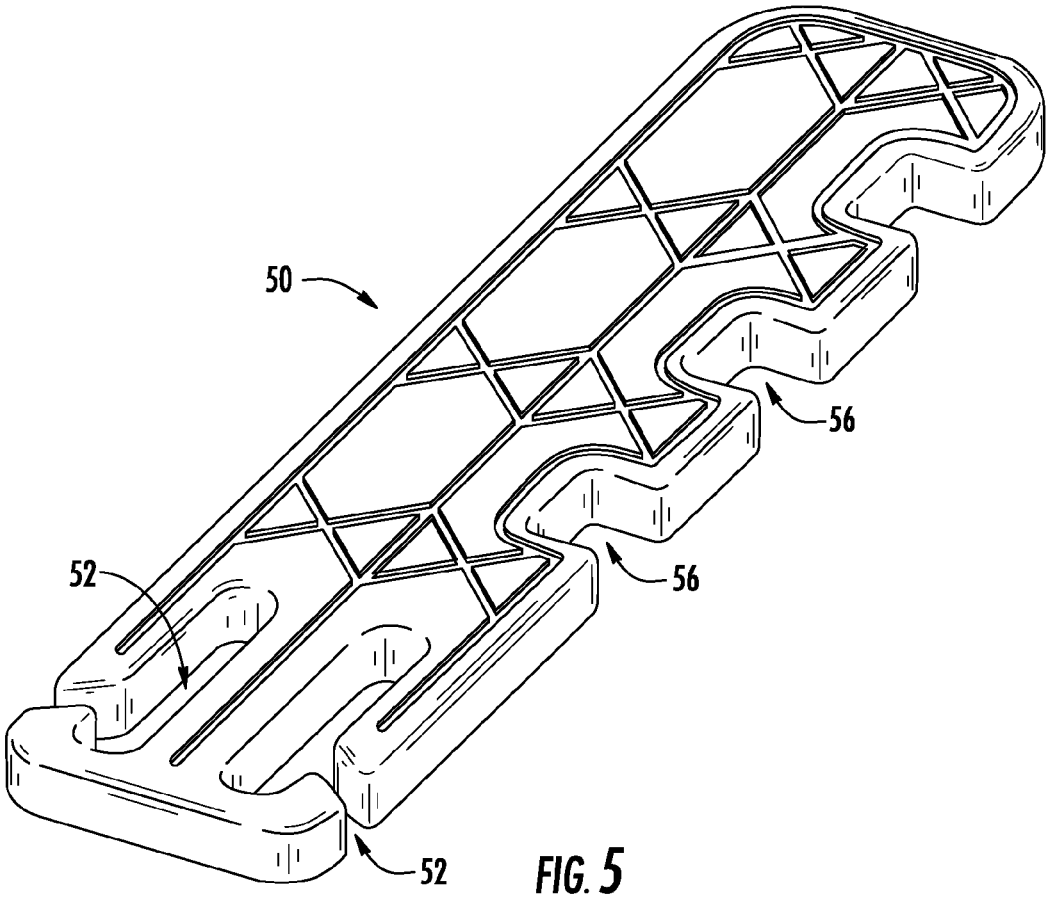
FIG. 5 is a schematic perspective view illustrating an adjustable post segment of the exemplary load transfer assembly of FIG. 1.
Figure 6:
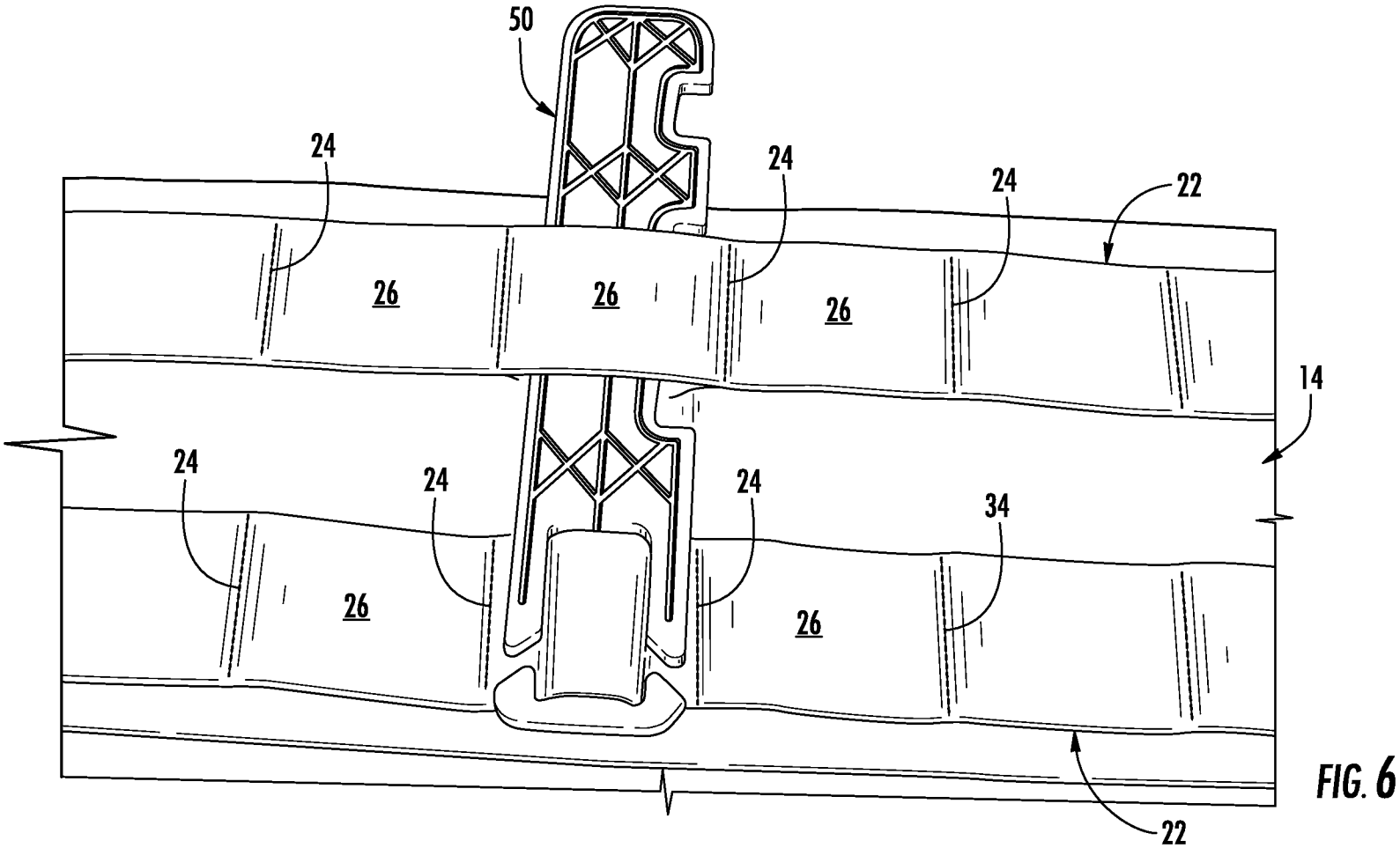
FIG. 6 is schematic perspective view illustrating the adjustable post segment of FIG. 5 held within webbing at the surface of a belt prior to use.

As best seen through joint reference to FIGS. 1, 5, and 6, the load transfer apparatus 10 also includes an insertable post 50 configured for mating receipt within the interior passageway 32. As shown, the post 50 may have a width dimension substantially greater than a thickness dimension so as to provide a substantially flat profile. The post 50 may be formed as a unitary solid structure from a rigid high impact plastic or other suitable material using techniques such as injection molding or the like as will be well known to those of skill in the art. The material forming the insertable post 50 may be either the same or different from the material forming the female body 30. If desired, surface patterning 55 may be molded into the face surfaces of the insertable post 50 to reduce slipping.

As best seen through joint reference to FIGS. 5 and 6, the distal end of the post 50 may have a convex curved geometry to facilitate insertion into the interior passageway 32. The proximal end of the post 50 may include a pair of opposing split eyelets 52 adapted to receive a portion of the belt webbing 22 in threaded relation as shown so as to be held in place. In this regard, the split eyelets 52 each may engage portions of the same belt loop 26 or each may engage different belt loops depending on the distance covered by the belt loops 26. Accordingly, the post 50 may be connected to the belt webbing without regard to the size of the belt loops 26. Moreover, as best seen in FIG. 6, the distal end of the post 50 may project through an opposing belt loop 26 if desired so as to be supported when not in use.

The post 50 preferably has an effective width and thickness corresponding substantially to the interior dimensions of the interior passageway 32 when the upper wall is in the unbiased condition without the thumb tab in the lifted condition. As illustrated, in the exemplary embodiment the post 50 includes an arrangement of lateral cutouts 56 disposed in spaced-apart series along one side of the post 50. The position and depth of the lateral cutouts 56 are set such that the locking tooth 34 will project into the lateral cutouts 56 after the post 50 is inserted into the interior passageway 32.

In operation, the post 50 is oriented generally transverse to the female body 30 and the distal end of the post 50 is inserted axially into the interior passageway 32 along the defined travel path. This insertion may take place either before or after the female body 30 and the post 50 are connected to their respective webbing supports. However, it may be desirable for at least one (and preferably both) of the components to be connected to its webbing support prior to insertion. During the insertion process, a user may insert the post 50 along the defined travel path until the desired degree of insertion has occurred. In this regard, the front edge of the post 50 may act on an angled or curved surface of the locking tooth 34 facing towards the post 50 to facilitate a sliding insertion even with the locking tooth 34 in the lowered position. Once the post 50 is in place, the locking tooth 34 will engage an opposing aligned cutout 56 thereby locking the post 50 at a defined position within the female body 30. Thereafter, the insertion may be reversed or adjusted as needed by simply lifting the thumb tab 38 so as to raise the locking tooth 34 away from the engaged cutout 56 and extracting or repositioning the post 50.

As best seen in FIG. 2, during use, the post 50 may be positioned at the belt webbing 22 for locked insertion into the female body 30 which is held at a segment of vest webbing 16. The level of insertion may be adjusted as required due to the arrangement of multiple lateral cutouts 56 along the length of the post 50. With the female body 30 and the post 50 in locked relation, the post 50 is loaded axially and is substantially incompressible. Thus, forces are transferred through the post 50 between the vest 12 and the belt 14, and a portion of the load may be shifted from a wearer's shoulders to the wearer's waist. The system works in both tension and compression.

As will be appreciated, while a single load transfer apparatus 10 is illustrated, a multiplicity of such devices may be used at positions around a user's waist. By way of example only, and not limitation, a closely spaced arrangement at the user's back may be particularly desirable in some circumstances to provide support. Moreover, it will be understood that the relative orientations of the post 50 and the female body 30 can be reversed if desired such that the post segment engages the vest webbing and the body segment engages the belt webbing.

Figure 7:
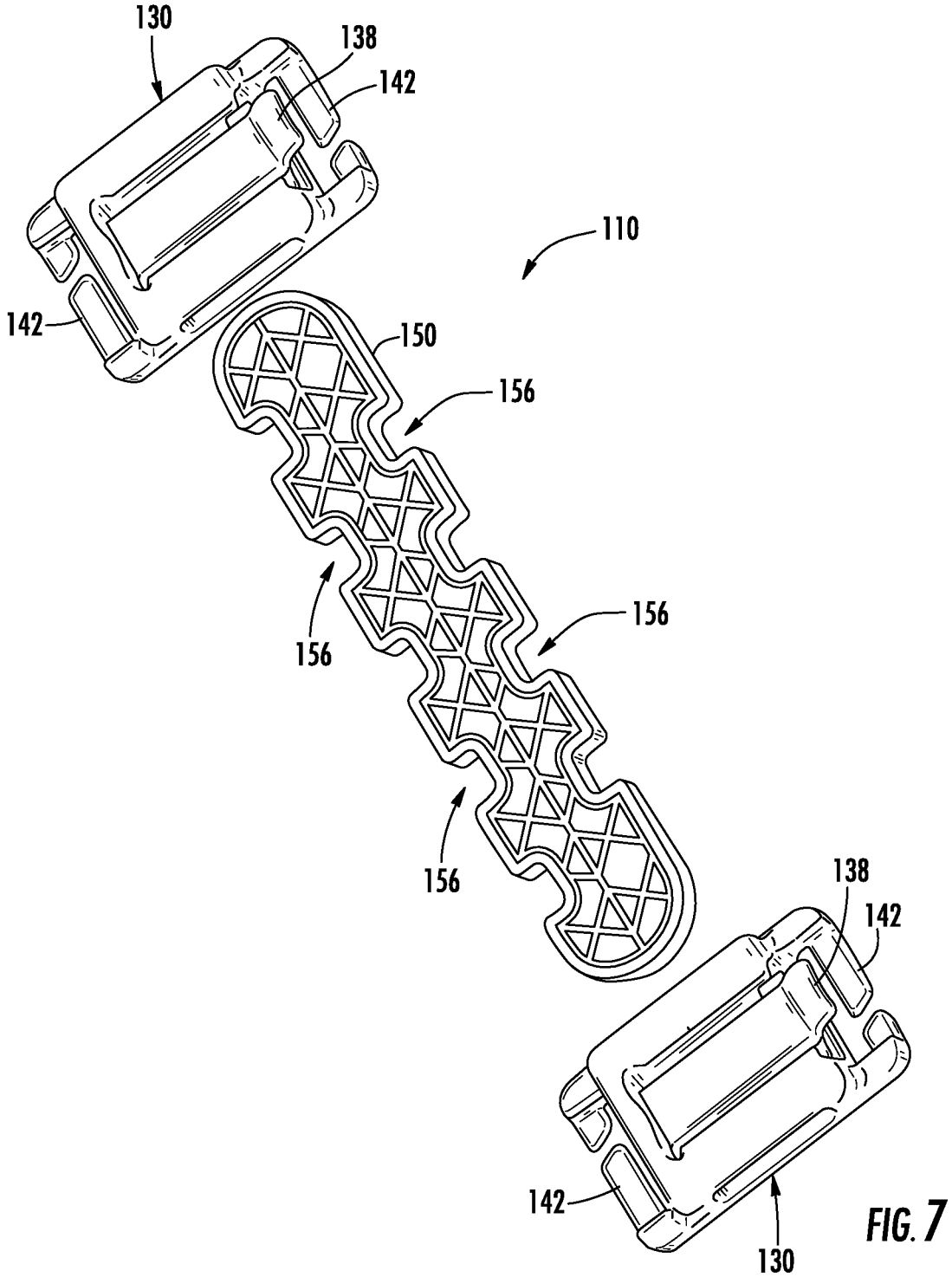
FIG. 7 is a schematic perspective view illustrating the components of a second exemplary embodiment of a load transfer assembly according to the present disclosure.

FIG. 7 illustrates an alternative exemplary embodiment of a load transfer apparatus 110 consistent with the present disclosure wherein like elements to those previously described are designated by like reference numerals within a 100 series. As shown, in the exemplary embodiment of FIG. 7, the insertable post 150 includes a series of lateral cut-outs 156 disposed along each side. In addition, both ends of the post 150 are of substantially similar rounded construction and are devoid of any split eyelets.

In the embodiment of FIG. 7, opposite ends of the post 150 may be inserted into opposing female bodies 130 as previously illustrated and described. That is, each of the female bodies 130 may have a configuration substantially as illustrated and described in relation to FIGS. 1 and 3. Thus, the post 150 may be inserted and locked in place between the opposing female bodies 130. In this condition, each of the female bodies 130 may be operatively attached to webbing loops on a vest or other torso covering garment and a belt structure respectively using split eyelets 142 in the manner as previously described. In this condition, load may be transferred along the post 150 between the vest or other torso covering garment and the belt structure. Following initial insertion, the post 150 thereafter may be removed or adjusted by raising the thumb tab so as to release the locking relationship.

As shown, the lateral cut-outs 156 are positioned in offset staggered relation along the opposing lateral sides of the post 150. That is, the cut-outs on one side are in offset relation to the cut-outs on the other side. As will be appreciated, such a construction provides enhanced adjustability through manipulation of the post orientation relative to the female bodies 130 to engage the locking teeth with the desired cut-outs on one side or the other.

Of course, variations and modifications of the foregoing are within the scope of the present invention. All dimensions are merely exemplary. Thus, it is to be understood that the invention disclosed and defined herein extends to all alternative combinations of two or more of the individual features mentioned or evident from the text and/or drawings. All of these different combinations constitute various alternative aspects of the present invention.

What is claimed is:

1. A load transfer apparatus adapted to transfer at least a portion of a load from a torso-covering garment to a belt structure supported at a user's waist so as to reduce stress on the user's upper body, the load transfer apparatus comprising:

at least a first female body including an open ended interior passageway defining a travel path across the first female body, the first female body including a deformable upper wall segment of flexible, resilient character bordering the interior passageway, a locking tooth projecting away from the deformable upper wall segment into the interior passageway, a liftable outwardly projecting tab operatively connected to the deformable upper wall segment such that upon lifting the tab, the deformable upper wall segment flexes upwardly and the locking tooth is elevated from an unbiased first position to a raised second position, and upon release of the tab, the deformable upper wall segment rebounds to its initial condition and the locking tooth returns to the unbiased first position, the first female body adapted to releasably engage webbing loops disposed at the surface of at least one of the torso-covering garment and the belt structure; and an insertable post adapted for insertion into the interior passageway, the insertable post including at least a first plurality of cutouts disposed in spaced-apart, stacked relation along a first lateral edge of the insertable post, the thickness dimension of the insertable post being such that the insertable post can pass beneath the locking tooth when the locking tooth is in the raised second position, the first plurality of cutouts being sized and positioned to receive the locking tooth when the insertable post is in inserted relation within the interior passageway and the locking tooth is lowered to the unbiased first position.

2. The load transfer apparatus as recited in claim 1, wherein the first female body has a unitary molded polymer construction.

3. The load transfer apparatus as recited in claim 1, wherein the interior passageway has a substantially rectangular cross-section.

4. The load transfer apparatus as recited in claim 3, wherein the interior passageway is circumferentially surrounded by the first female body.

5. The load transfer apparatus as recited in claim 1, wherein the deformable upper wall segment is disposed in spanning relation between a pair of strengthening ribs.

6. The load transfer apparatus as recited in claim 5, wherein the deformable upper wall segment has a reduced thickness relative to the strengthening ribs.

7. The load transfer apparatus as recited in claim 6, wherein the locking tooth is molded integrally with the deformable upper wall segment.

8. The load transfer apparatus as recited in claim 6, wherein the locking tooth is disposed at a position adjacent to a lateral edge of the deformable upper wall segment.

9. The load transfer apparatus as recited in claim 8, wherein the tab is molded integrally with the deformable upper wall segment along said lateral edge of the deformable upper wall segment and includes a pair of opposing ears projecting outwardly away from the tab at a position below the deformable upper wall segment, the opposing ears being adapted to contact the strengthening ribs to limit the distance the tab can be raised.

10. The load transfer apparatus as recited in claim 1, wherein the first female body includes a pair of split eyelets disposed at an elevation below the deformable upper wall segment adapted to releasably engage the webbing loops disposed at the surface of said at least one of the torso-covering garment and the belt structure.

11. The load transfer apparatus as recited in claim 1, further comprising a second female body including an open ended interior passageway defining a travel path across the second female body, the second female body including a deformable upper wall segment of flexible, resilient character bordering the interior passageway, a locking tooth projecting away from the deformable upper wall segment into the interior passageway, a liftable outwardly projecting tab operatively connected to the deformable upper wall segment such that upon lifting the tab, the deformable upper wall segment flexes upwardly and the locking tooth is elevated from an unbiased first position to a raised second position, and upon release of the tab, the deformable upper wall segment rebounds to its initial condition and the locking tooth returns to the unbiased first position, the second female body adapted to releasably engage webbing loops disposed at the surface of at least one of the torso-covering garment and the belt structure, and wherein the insertable post is adapted for locking insertion into the interior passageway of the second female body.

12. The load transfer apparatus as recited in claim 11, wherein the insertable post includes a second plurality of cutouts disposed in spaced-apart, stacked relation along a second lateral edge opposing the first lateral edge.

13. The load transfer apparatus as recited in claim 12, wherein the first plurality of cutouts are disposed in staggered relation to the second plurality of cutouts along the length of the post.

14. The load transfer apparatus as recited in claim 1, wherein the insertable post includes a pair of split eyelets disposed at a proximal end of the post adapted to releasably engage the webbing loops disposed at the surface of said at least one of the torso-covering garment and the belt structure.

15. A load transfer apparatus adapted to transfer at least a portion of a load from a torso-covering garment to a belt structure supported at a user's waist so as to reduce stress on the user's upper body, the load transfer apparatus comprising:

at least a first female body of unitary polymeric molded construction including an open ended interior passageway defining a travel path across the first female body, the interior passageway being circumferentially surrounded by the first female body, the first female body including a deformable upper wall segment of flexible, resilient character disposed in spanning relation between a pair of enhanced thickness stiffening ribs, a locking tooth molded integrally with the deformable upper wall segment and projecting away from the deformable upper wall segment into the interior passageway at a position adjacent to a lateral edge of the deformable upper wall segment, a liftable outwardly projecting tab molded integrally with the deformable upper wall segment along said lateral edge of the deformable upper wall segment, such that upon lifting the tab, the deformable upper wall segment flexes upwardly and the locking tooth is elevated from an unbiased first position to a raised second position, and upon release of the tab, the deformable upper wall segment rebounds to its initial condition and the locking tooth returns to the unbiased first position, the first female body further including a pair of split eyelets disposed at an elevation below the deformable upper wall segment and adapted to releasably engage webbing loops disposed at the surface of at least one of the torso-covering garment and the belt structure; and an insertable post of unitary polymeric molded construction adapted for insertion into the interior passageway, the insertable post including a plurality of cutouts disposed in spaced-apart, stacked relation along at least a first lateral edge of the insertable post, the thickness dimension of the insertable post being such that the insertable post can pass beneath the locking tooth when the locking tooth is in the raised second position, the cutouts being sized and positioned to receive the locking tooth when the insertable post is in inserted relation within the interior passageway and the locking tooth is lowered to the unbiased first position.

16. The load transfer apparatus as recited in claim 15, wherein the interior passageway has a substantially rectangular cross-section.

17. The load transfer apparatus as recited in claim 15, wherein the insertable post includes a pair of split eyelets disposed at a proximal end of the post adapted to releasably engage the webbing loops disposed at the surface of said at least one of the torso-covering garment and the belt structure.

18. The load transfer apparatus as recited in claim 15, wherein the insertable post has a width dimension greater than a thickness dimension.

19. The load transfer apparatus as recited in claim 15, further comprising a second female body including an open ended interior passageway defining a travel path across the second female body, the second female body including a deformable upper wall segment of flexible, resilient character bordering the interior passageway, a locking tooth projecting away from the deformable upper wall segment into the interior passageway, a liftable outwardly projecting tab operatively connected to the deformable upper wall segment such that upon lifting the tab, the deformable upper wall segment flexes upwardly and the locking tooth is elevated from an unbiased first position to a raised second position, and upon release of the tab, the deformable upper wall segment rebounds to its initial condition and the locking tooth returns to the unbiased first position, the second female body adapted to releasably engage webbing loops disposed at the surface of at least one of the torso-covering garment and the belt structure, and wherein the insertable post is adapted for locking insertion into the interior passageway of the second female body.

20. A load transfer apparatus adapted to transfer at least a portion of a load from a torso-covering garment to a belt structure supported at a user's waist so as to reduce stress on the user's upper body, the load transfer apparatus comprising:

at least a first female body of unitary polymeric molded construction including an open ended interior passageway of substantially rectangular cross section defining a travel path across the first female body, the interior passageway being circumferentially surrounded by the first female body, the first female body including a deformable upper wall segment of resilient flexible character bordering the interior passageway, the deformable upper wall segment being disposed in spanning relation between a pair of stiffening ribs, wherein the deformable upper wall segment has a reduced thickness relative to the strengthening ribs, a locking tooth molded integrally with the deformable upper wall segment and projecting away from the deformable upper wall segment into the interior passageway at a position adjacent to a lateral edge of the deformable upper wall segment, a liftable outwardly projecting tab molded integrally with the deformable upper wall segment along said lateral edge of the deformable upper wall segment at a position outboard from the interior passageway, such that upon lifting the tab, the deformable upper wall segment flexes upwardly and the locking tooth is elevated from an unbiased first position to a raised second position, and upon release of the tab, the deformable upper wall segment rebounds to its initial condition and the locking tooth returns to the unbiased first position, wherein the tab includes a pair of opposing ears projecting outwardly away from the tab at a position below the deformable upper wall segment, the opposing ears being adapted to contact the strengthening ribs to limit the distance the tab can be raised, the first female body further including a pair of split eyelets disposed at an elevation below the deformable upper wall segment and adapted to releasably engage webbing loops disposed at the surface of at least one of the torso-covering garment and the belt structure; and an insertable post of unitary polymeric molded construction adapted for insertion into the interior passageway, the insertable post having a width dimension greater than a thickness dimension, and wherein the effective width of the insertable post substantially matches the width dimension of the interior passageway, the insertable post including a plurality of cutouts disposed in spaced-apart, stacked relation along a first lateral edge of the insertable post, the thickness dimension of the insertable post being such that the insertable post can pass beneath the locking tooth when the locking tooth is in the raised second position, the cutouts being sized and positioned to receive the locking tooth when the insertable post is in inserted relation within the interior passageway and the locking tooth is lowered to the unbiased first position, the insertable post further including a pair of split eyelets disposed at a proximal end of the post and adapted to releasably engage webbing loops disposed at the surface of at least one of the torso-covering garment and the belt structure.

* * * * *